US009422672B2

(12) United States Patent
Carpentier et al.

(10) Patent No.: US 9,422,672 B2
(45) Date of Patent: Aug. 23, 2016

(54) DEVICE TO MAINTAIN A TRAJECTORY OF A GUIDED VEHICLE IN THE EVENT OF DERAILMENT AND/OR FAILURE OF GUIDANCE

(71) Applicant: SIEMENS S.A.S, St. Denis (FR)

(72) Inventors: Philippe Carpentier, Lomme (FR); Yves Clarissou, Paris (FR); Luciano Consoli, Paris (FR)

(73) Assignee: Siemens S.A.S., St. Denis (FR)

( * ) Notice: Subject to any disclaimer, the term of this patent is extended or adjusted under 35 U.S.C. 154(b) by 152 days.

(21) Appl. No.: 14/386,882

(22) PCT Filed: Feb. 12, 2013

(86) PCT No.: PCT/EP2013/052793

§ 371 (c)(1),
(2) Date: Sep. 22, 2014

(87) PCT Pub. No.: WO2013/139534

PCT Pub. Date: Sep. 26, 2013

(65) Prior Publication Data

US 2015/0033976 A1 Feb. 5, 2015

(30) Foreign Application Priority Data

Mar. 21, 2012 (EP) ..... 12290100

(51) Int. Cl.
*B61F 9/00* (2006.01)
*E01B 5/18* (2006.01)

(52) U.S. Cl.
CPC .... *E01B 5/18* (2013.01); *B61F 9/00* (2013.01)

(58) Field of Classification Search
CPC ..... E01B 5/18; E01B 25/28; E01B 25/00; B61F 9/00; B61F 5/24; B62D 1/26; B62D 1/265; A63G 7/00
USPC ..... 104/242, 243, 244, 244.1, 245, 246, 104/248
See application file for complete search history.

(56) References Cited

U.S. PATENT DOCUMENTS 303,713 A * 8/1884 Pere ..... B61F 9/00 104/246
570,746 A * 11/1896 Curtis ..... A63G 7/00 104/248
754,698 A * 3/1904 Reed ..... A63G 21/18 104/246
2,800,861 A * 7/1957 Michalski ..... B61F 9/00 104/242

(Continued)

FOREIGN PATENT DOCUMENTS

FR 2649658 A1 1/1991
WO WO2010095290 * 8/2010

*Primary Examiner* — Mark Le
(74) *Attorney, Agent, or Firm* — Laurence Greenberg; Werner Stemer; Ralph Locher

(57) ABSTRACT

A device to be fitted to a guided vehicle moving on a track having a guide rail and two side rails parallel to and on each side of the guide rail maintains a trajectory of the vehicle upon derailment. The vehicle includes a guidance unit having guide wheels to be supported on the guide rail. The device includes a bar to be fixed to the guidance unit transverse to the track. The bar has a length L between a distance D mutually separating the side rails minus the width C of the head of the guide rail and the distance D mutually separating side rails, i.e. D−C<L<D. A fixing device fixes the bar to the guidance unit with the bar transversely between and level with the side rails and supported on one of the side rails during a derailment and/or failure of vehicle guidance.

14 Claims, 4 Drawing Sheets

(56) References Cited

U.S. PATENT DOCUMENTS 3,180,280 A * 4/1965 Kuch ..... B62D 1/265 104/245
3,817,186 A * 6/1974 Walsh ..... B61F 9/00 104/243
3,872,794 A * 3/1975 Goode ..... B62D 1/265 104/247
4,027,596 A 6/1977 Nardozzi, Jr.

* cited by examiner

DEVICE TO MAINTAIN A TRAJECTORY OF A GUIDED VEHICLE IN THE EVENT OF DERAILMENT AND/OR FAILURE OF GUIDANCE

BACKGROUND OF THE INVENTION

Field of the Invention

The present invention relates to a device to maintain a trajectory of a guided vehicle capable of moving on a track in the event of derailment and/or failure of guidance of said guided vehicle, including at least one guide rail and two side rails parallel to said guide rail and positioned on each side of the latter, said guided vehicle including a guidance unit including guide wheels, each of the guide wheels being intended to be supported on said guide rail.

"Guided vehicle" refers to means of public transport such as buses, trolley buses, trams, metros, trains or train units, etc., but also to means of transporting loads such as, for example, traveling cranes, for which the safety aspect is very important and for which guidance is provided in particular by a single rail. The latter acts as a guide for a guidance unit which is generally supported on the rail and follows its trajectory when the guided vehicle is moving. The guidance unit enables for example a guidance system to direct a steering axle of the vehicle along the trajectory defined by the rail, said axle being for example fitted with bogie wheels.

A first known variant of the guidance unit includes a pair of guide wheels, also called guide pulleys, mounted in a V and fitted with flanges making it possible to grip the guide rail. Such a guidance unit is for example described in documents U.S. Pat. Nos. 7,228,803 B2, 6,029,579 A1, 6,363,860 B1. Such a guidance unit secures the guidance of the vehicle until it stops. It makes it possible for example to avoid material damage which might result from a loss of guidance and to preserve the physical integrity of the staff or passengers on board in the case of public transport.

Vehicles guided by this type of guidance unit operate in accordance with the following general principle, referring to FIG. 1: said guidance unit follows the rail 3 by means of the pair of pulleys 1, 2 in contact with the rail 3 and gives the guidance system a direction to be imposed on a steering axle of the vehicle. The guide rail 3 is in particular made of a base plate 4 fixed to the ground 5 and a core 6 supporting a head 7 on which the pulleys 1, 2 are supported via a tread 9. Each of the pulleys 1, 2 in the same pair of guide pulleys thus has its tread 9 in contact with a surface of the head 7, called the running surface 8, and distributed symmetrically on each side of the upper part of the head 7. When the vehicle is moving, the pulleys 1, 2 are in contact with the head 7, and their respective flanges 10 encircle, without contact in nominal mode, the latter and come closer to the core 6 below it. Since the distance between the lower ends 201, 101 of the two flanges 10 encircling the head 7 is less than the width C of the head 7, extraction of the head 7 out of the grip of said pulleys 1, 2, or even out of the zone included between the treads 9 and the flanges 10, is only possible if the angle 11 at which the pulleys are fixed, i.e. the angle corresponding to the sector formed by the axes of rotation of each of the pulleys 1, 2 of a pair of pulleys and cut by the plane of symmetry of the pair of pulleys in a V, increases and/or if the flanges 10 and/or the outer edges of the head 7 are deformed.

The correct orientation of the vehicle is thus obtained by coupling the pair of pulleys of the guidance unit of the guidance system with the steering axle of the vehicle. If the pulleys are correctly gripping the guide rail, the vehicle follows the trajectory described by the rail when it is moving. On the other hand, if the pulleys leave their normal operating position, for example, if the head of the guide rail leaves the zone included between the treads and the flanges, then the vehicle risks leaving the trajectory initially established by the rail. In fact, as soon as the pulleys are no longer restricted to the direction imposed by the guide rail, they can depart towards the right or left of the rail, thus deflecting the vehicle from the planned trajectory. The scenario in question is defined as a loss of guidance or simply failure of guidance of the vehicle. In other words, the correct positioning of the pulleys is a necessary condition to guarantee the correct direction of the vehicle.

A second variant of the guidance unit is described in document WO 2008/074942 A1 and consists of a pair of pulleys gripping a head, as described above, but with the difference that the pulleys have no flanges. In this case, the flanges of the wheels are replaced by fixed flanges integrated with a fixing base for the pulleys, the latter also being protected by a safety shield. This configuration produces greater rigidity, which increases the effort needed to extract the pulleys from the rail.

Whichever variant of the guidance unit considered, extraction of the head out of the grip of the pulleys is possible. This is the case for example when a vertical pulling effort directed upwards is applied to the pulleys or on a fixing base for pulleys so that deformation of the parts (flange and/or head and/or pulley axis) means that the distance between the flanges exceeds the width of the head. In this case, the pulleys no longer grip the rail and can be positioned either alongside it, as shown in FIG. 2, or on top of the guide rail, as illustrated by FIG. 3, the references used in FIG. 1 also being used for FIGS. 2 and 3. When positioned on top of the guide rail, the vehicle can still be guided even if the guidance unit is no longer gripping the guide rail. On the other hand, if the guide pulleys are positioned alongside the guide rail, deflection of the bogie wheels may cause the guided vehicle to leave its initially planned trajectory, which could have disastrous consequences for the operation of the vehicle and the network to which it belongs, and for the safety of the passengers and staff on board.

Thus, the current guidance systems for guided vehicles do not make it possible to ensure maintenance of the trajectory of said guided vehicle in the event of derailment.

BRIEF SUMMARY OF THE INVENTION

An objective of the present invention is to propose a simple device, safe and reliable, to maintain the trajectory of a guided vehicle in the event of derailment or a loss of guidance of it. In other words, this involves in particular rapidly and reliably preventing the guidance system of a guided vehicle being able to retain its ability to deflect by means of driving rods in the event of loss of guidance and/or derailment.

In order to achieve this objective, a device according to the present invention is proposed.

A set of sub-claims also presents advantages of the invention.

The present invention relates to a device to maintain a trajectory, intended to be fitted to a guided vehicle capable of moving on a track including at least one guide rail and two side rails which are, for example, current rails, said side rails being parallel to said guide rail and positioned, in particular symmetrically, on each side of the latter and said guide rail defining a trajectory for the guided vehicle. Said guided vehicle includes in particular a guidance system for the guidance of said vehicle along the trajectory imposed by the guide rail. The guidance system includes in particular a guidance unit including guide wheels or pulleys, each of the guide wheels being intended to be supported on said guide rail in order to impose upon said guided vehicle, via said guidance unit, said trajectory defined by the guide rail. Said maintaining device is characterized in that it includes:

a. a bar intended to be fixed to said guidance unit so as to be transverse to the track and thus to the guide rail, said bar having length L between the distance D separating the side rails from one another minus the width C of the head of said guide rail and said distance D separating the side rails from one another, i.e. $D-C<L<D$;

b. a fixing means suitable for fixing said bar to said guidance unit so that said bar is positioned transversely to the track, and thus to the guide rail, between and at the level of said side rails so as to be supported on one or other of said side rails during a derailment and/or failure of guidance of said guided vehicle so as to guide said guided vehicle by imposing upon said guidance unit the trajectory defined by the guide rail.

In fact, since the side rails are parallel to the guide rail, they are also capable of controlling movement of the guided vehicle along said trajectory imposed by the guide rail. The side rails may in particular be current or feed rails intended to supply electrical energy to said guided vehicle or side rails configured for the guidance of said guided vehicle in the event of derailment or failure of guidance of said guided vehicle through cooperation with a device to maintain a trajectory according to the invention. For this purpose, said bar is configured so as to maintain the ends of the pulleys in position on the guide rail as shown in FIG. 3 or 4. Ends of pulleys refers in particular to the flange fitted to a pulley or wheel, but also to a pulley shield or fairing supported by the guide rail in the event of derailment or loss of guidance as illustrated schematically in FIG. 3 when said guided vehicle is fitted with a device to maintain the trajectory according to the invention. The geometry and structure of the bar, as well as the means of fixing said bar to said guidance unit, make it possible in particular to transmit to said guidance unit a direction to be followed so as to maintain said guided vehicle along the trajectory defined by the guide rail.

Preferably, said bar and/or said fixing means include an insulating material capable of preventing a transfer of electricity from one of said side rails to said guided vehicle during contact between said bar and said side rail, in particular in the particular case when the side rail is a current rail. For example, said bar may include at each of its ends said insulating material, and/or be made of said insulating material and/or covered at least in part with a layer of said insulating material.

Preferably, said guide bar includes a jaw capable of encircling the head of said rail so as to act as a track clearer when used on a correctly rerailed guided vehicle. In particular, projecting parts of said jaw extend, during use of said maintenance device according to the invention, to each side of the head, beneath the latter, the distance separating the ends of said projecting parts of the jaw beneath said head being less than the width of said head so as to prevent the head of said rail slipping out of the grip of said jaw during use of said maintaining device according to the invention.

Said bar is in particular perceptibly parallelepiped in shape. According to a preferred embodiment, said bar has at least a part of one of its ends beveled, such that, for example from a front view, the global geometrical shape of the bar corresponds substantially to a rectangle onto which an isosceles trapezium is superimposed, the base of which has a length identical to the length of the rectangle, and the top has a length less than the base. Thus, the geometrical shape of the bar provides in particular for self-centering of said bar between the side rails in the event of derailment and/or failure of guidance of the guided vehicle. Furthermore, said bar may in particular include on at least one of its ends a support castor configured to be supported on one of said side rails during said derailment and/or failure of guidance of said guided vehicle.

Preferably, the fixing means is in particular capable of fixing said bar to a fixing base of a guide wheel/pulley or wheels/pulleys of the guidance unit. Furthermore, said fixing means may in particular fix said bar to said guidance unit rigidly or flexibly, i.e. so as to cushion the transmission to the guidance unit of a shock between an object and said bar. For this purpose, the fixing means preferably includes a shock absorbing device, including for example a hydraulic and/or spring shock absorbing system.

The present invention also relates to a guidance unit of a guided vehicle including said device to maintain a trajectory as described above, said unit being in particular characterized in that it includes a pair of said guide wheels mounted in a V with the point directed downwards and fitted with flanges making it possible to grip the guide rail. The present invention also relates to a guided vehicle including said maintaining device as described above.

BRIEF DESCRIPTION OF THE SEVERAL VIEWS OF THE DRAWINGS

Finally, exemplary embodiment and applications are provided by means of.

DESCRIPTION OF THE INVENTION

Figure 1:
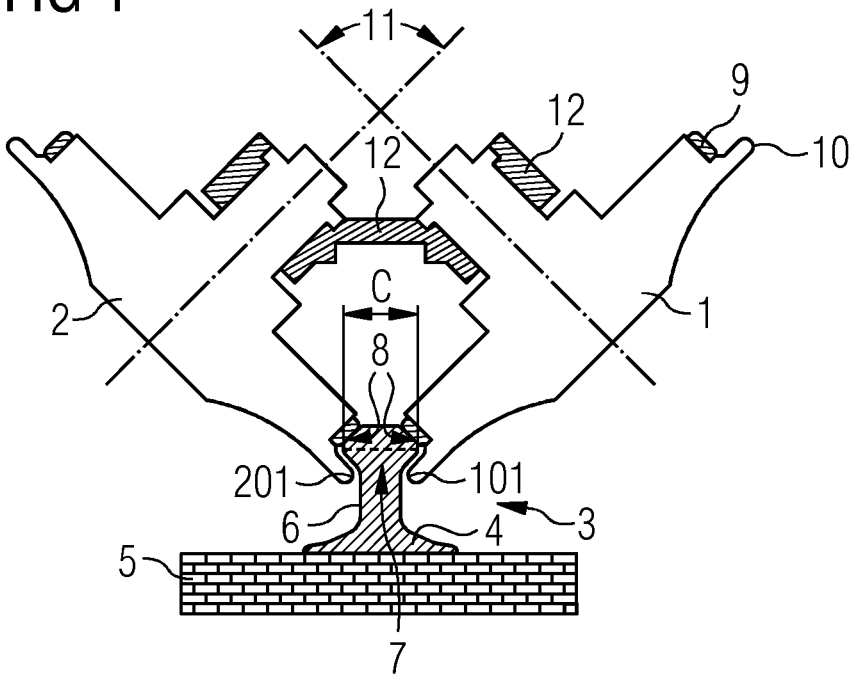
FIG. 1 pair of guide pulleys correctly rerailed in nominal mode on a guide rail.
Figure 2:
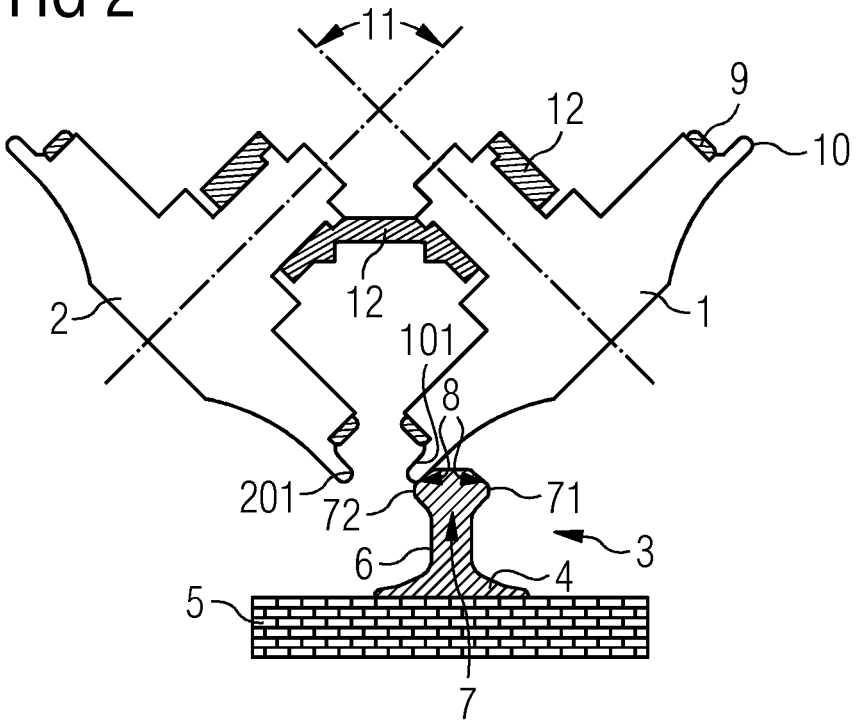
FIG. 2 positioning of a pair of guide pulleys alongside a guide rail during a derailment.
Figure 3:
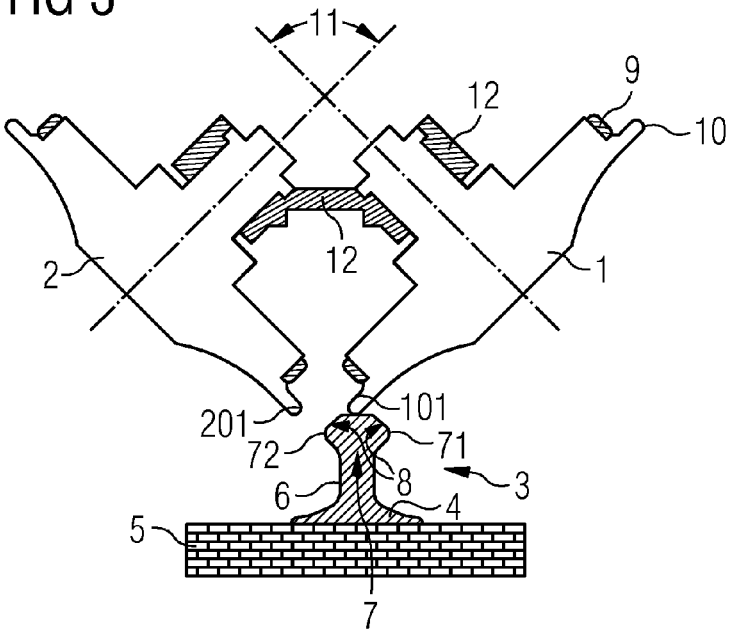
FIG. 3 positioning of a pair of guide pulleys on top of a guide rail during a derailment.

FIGS. 1 to 3 respectively show correct rerailing of a pair of pulleys 1, 2 on a guide rail 3 representing the nominal mode of operation of the pair of pulleys 1, 2, a case of derailment of the pair of pulleys 1, 2 alongside said guide rail 3 and a case of derailment of the pair of pulleys 1, 2 on top of the guide rail 3, each pulley being mounted on a fixing base 12 of the guidance unit. The derailment of the pair of pulleys 1, 2 alongside the guide rail 3 may lead to deflection of the guidance unit likely to result in a loss of trajectory for the guided vehicle.

Figure 4:
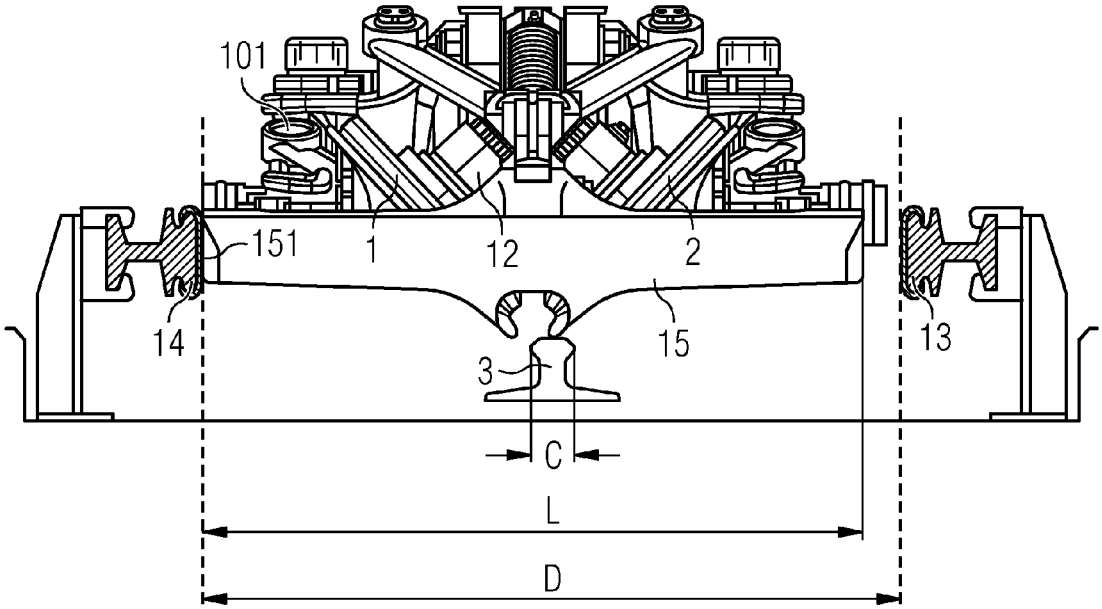
FIG. 4 positioning of guide pulleys during a derailment of a guided vehicle fitted with a maintaining device according to the invention.

In order to avoid such a problem, the present invention proposes fitting the guidance unit of a guided vehicle with a trajectory maintaining device. To this effect, FIG. 4 shows an exemplary embodiment of a maintaining device according to the invention, mounted on a guidance unit of a guided vehicle which has derailed. The guided vehicle may for example run on a track including a guide rail 3 and side rails 13, 14, which may for example supply electrical current to said guided vehicle. A guidance unit including a pair of guide wheels or pulleys 1, 2 mounted in a V with the point directed downwards, enables the guided vehicle to follow the trajectory described by the guide rail 3 in nominal mode. In the event of a derailment as shown in FIG. 4, the maintaining device according to the invention makes it possible to maintain said trajectory of said guided vehicle despite the derailment and/or failure of guidance. The maintaining device according to the invention includes in particular:

a. a bar 15 intended to be fixed to said guidance unit, for example to a fixing base 12 for pulleys 1,2 of said guidance unit so as to be transverse to the track and thus to the guide rail 3, said bar 15 having length L between the distance D separating the side rails 13, 14 from one another minus the width C of the head of said guide rail 3 and said distance D separating the side rails from one another, i.e. $D-C<L<D$;

b. a fixing means suitable for fixing said bar 15 to said guidance unit so that said bar is positioned transversely to the track and thus to the guide rail 3, between and at the level of said side rails 13, 14 so as to be supported on one or other of said side rails 13, 14 during a derailment and/or failure of guidance of said guided vehicle, such that said bar 15 is capable of imposing upon said guidance unit the trajectory defined by the guide rail 3.

Figure 5:
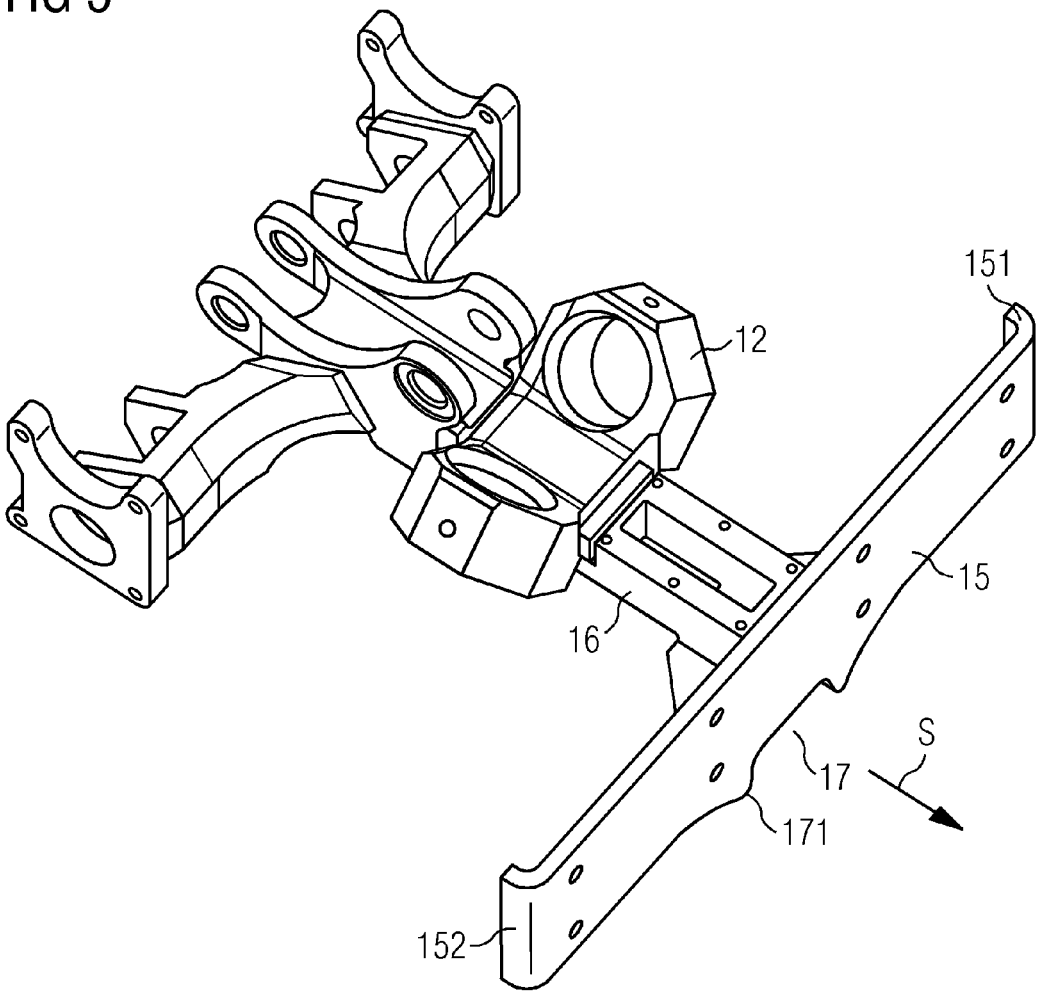
FIG. 5 example of fixing of a maintaining device according to the invention to a pulley fixing base of a guidance unit.
Figure 6:
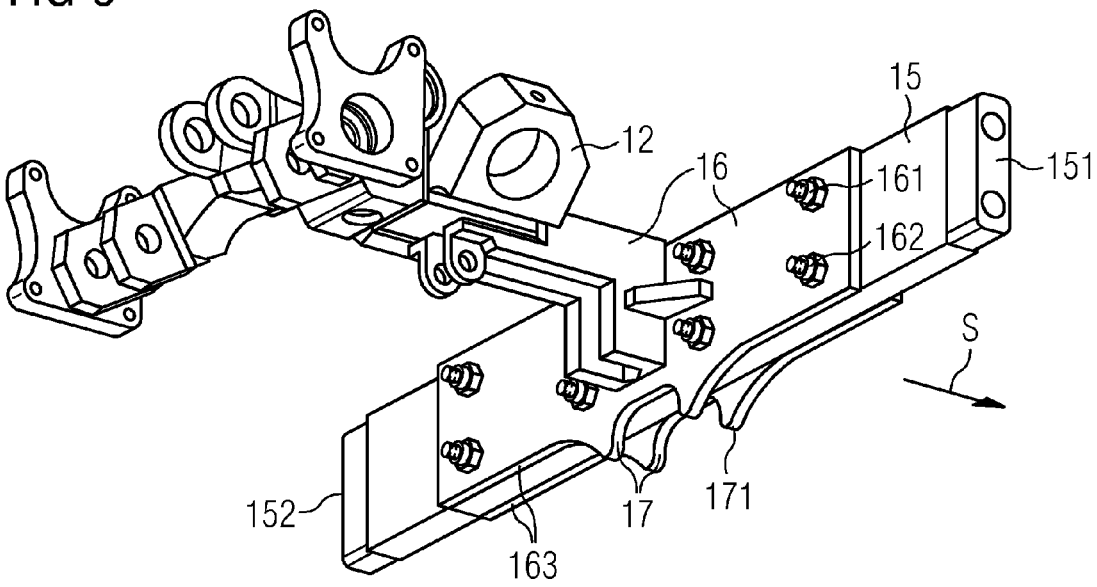
FIG. 6 exemplary embodiment according to the invention of a trajectory maintaining device.

Preferably, said bar 15 is mounted ahead of said guidance unit in relation to a direction of movement S of said guided vehicle, as shown in FIG. 5 and FIG. 6. Each end 151, 152 of the bar 15 is in particular bent in a direction opposite to the direction of movement S of said vehicle, or may simply include an insulating end piece, metal or otherwise. A fixing means 16 may for example integrate said bar 15 with a fixing base 12 for the pulleys of the guidance unit. The fixing means includes in particular a system of nuts 162 and bolts 161 capable of fixing said bar 15 to said guidance unit, for example to said fixing base 12 of said guidance unit. In particular, the system of nuts 162 and bolts 161 may cooperate with a system of plates 163 to maintain said bar integrated with said fixing base 12. Preferably, the maintaining device according to the invention, for example said bar 15 and/or said plates 163, includes a jaw 17 capable of encircling the head of said guide rail 3, in particular through projecting parts 171 of said jaw 17, so as to act as a track clearer during use on a correctly rerailed guided vehicle. The jaw 17 is in particular configured so as to allow play of about 14 mm all around the head of the guide rail 3. The value of said play is in particular determined so that said play avoids contact between said jaw and the guide rail during lateral and vertical movements and rocking and pitching rotations of the pulleys, while also taking wear of pulleys into consideration.

Figure 7:
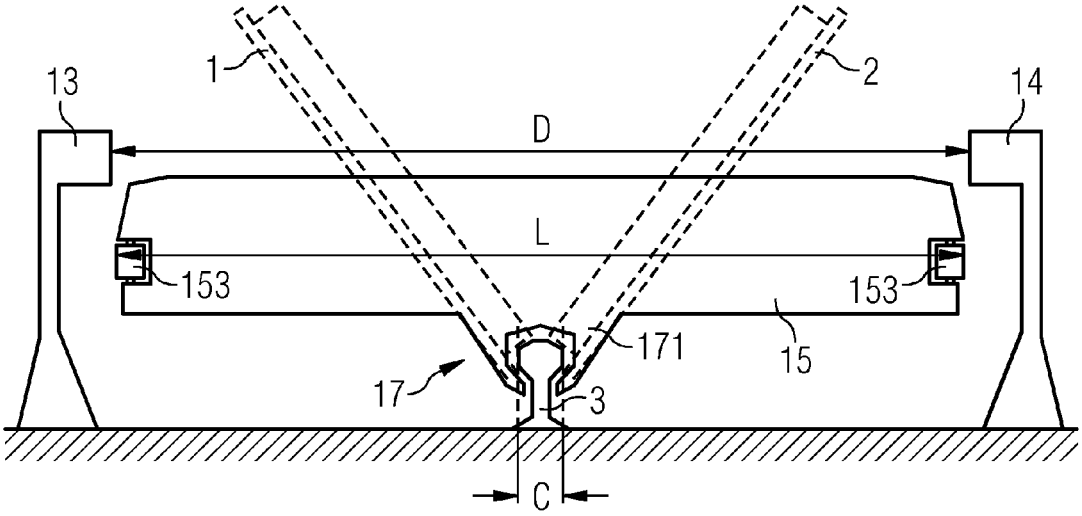
FIG. 7 exemplary embodiment according to the invention of a bar fitted with support castors.

FIG. 7 shows an exemplary embodiment of the bar 15 according to the invention. The references on the preceding figures are retained in FIG. 7 for identical objects. Preferably, said bar 15 is for example made of a metallic material or an alloy (for example steel, stainless steel, etc.), or a composite material (for example, glass fiber, carbon fiber, etc.), or a mixture of a metallic material and a composite, for example metal covered with composite. The choice is in particular made with reference to the mechanical efforts and the presence of current in the side rails 13, 14. Preferably, said bar 15 is structured so as to minimize its longitudinal flexion. A length L typical of the bar 15 is for example 768 mm for side rails 13, 14 spaced at 800 mm, so as to guarantee a play of about 16 mm between each end of the bar 15 and the side rail during a derailment or loss of guidance of said guided vehicle. In particular, each end of the bar 15 may be fitted with a support castor 153 configured to be supported on said side rail 13, 14 during derailment or loss of guidance of the guided vehicle.

To summarize, the device according to the invention presents the following advantages:

- a reduced number of components likely to cause a failure, implying in particular low development, manufacture, installation and maintenance costs;
- resistance to the restrictive external environments associated with guided vehicles;
- securing and maintaining the trajectory in the event of derailment of the guidance unit;
- a function of track clearer for the device according to the invention making it possible to remove objects lying on the guidance track and protect the guidance unit, in particular by means of said jaw fitted to the bar according to the invention.

The invention claimed is:

1. In a system having a track including at least one guide rail having a head with a width C and two side rails each disposed parallel to the guide rail and positioned on a respective side of the guide rail and mutually separated by a distance D, and a guided vehicle including a guidance unit having guide wheels to be supported on the guide rail, a device to be fitted to the guided vehicle for maintaining a trajectory of the guided vehicle moving on the track, the trajectory maintaining device comprising:

a. a bar configured to be fixed to the guidance unit so as to be transverse to the track, said bar having length L dimensioned between the distance D mutually separating the side rails minus the width C of the head of said guide rail and the distance D mutually separating the side rails: $D-C<L<D$; and b. a fixing device configured to fix said bar to the guidance unit with said bar positioned transversely between and at a level of the the rails so as to be supported on one or the other of the side rails during at least one of a derailment or a failure of guidance of the guided vehicle.

2. The trajectory maintaining device according to claim 1, wherein at least one of said bar or said fixing device includes an insulating material configured to prevent a transfer of electricity from one of the side rails to the guided vehicle during contact between said bar and the side rail when the side rail is a current or feed rail.

3. The trajectory maintaining device according to claim 1, wherein said fixing device is configured to fix said bar to a fixing base for a guide wheel of the guidance unit.

4. The trajectory maintaining device according to claim 1, wherein said guide bar includes a jaw configured to encircle the head of the rail so as to act as a track clearer when used on a correctly rerailed guided vehicle.

5. The trajectory maintaining device according to claim 4, wherein:

said jaw has projecting parts extending, during use of the trajectory maintaining device, to each side of the head, beneath the head; and said projecting parts of said jaw have ends separated by a distance beneath the head being less than the width of the head so as to prevent the guide rail slipping out of a grip of said jaw during use of the trajectory maintaining device.

6. The trajectory maintaining device according to claim 2, wherein said bar has ends each having said insulating material.

7. The trajectory maintaining device according to claim 2, wherein said bar is made of said insulating material or is covered at least in part with a layer of said insulating material.

8. The trajectory maintaining device according to claim 1, wherein said bar has ends and at least a part of one of said ends is beveled.

9. The trajectory maintaining device according to claim 1, wherein said bar has ends and a support castor disposed on at least one of said ends and configured to be supported on one of the side rails during at least one of a derailment or a failure of guidance of the guided vehicle.

10. The trajectory maintaining device according to claim 1, wherein said bar is made of steel.

11. The trajectory maintaining device according to claim 1, wherein said fixing device includes a shock absorbing device configured to cushion a transmission of a shock between an object and said bar to the guidance unit.

12. A guidance unit of a guided vehicle, the guidance unit comprising the trajectory maintaining device according to claim 1.

13. The guidance unit according to claim 12, which further comprises a pair of said guide wheels mounted in a V and fitted with flanges permitting said guide wheels to grip the guide rail.

14. A guided vehicle, comprising the trajectory maintaining device according to claim 1.

* * * * *